United States Patent [19]

Vincenzo

[11] Patent Number: 5,072,501

[45] Date of Patent: Dec. 17, 1991

[54] DEVICE FOR RESTORING LOST FLUID PRESSURE PARTICULARLY IN RIVETING MACHINES

[75] Inventor: Cariati Vincenzo, Bologna, Italy

[73] Assignee: FAR S.n.c. di Generali Giacomo, Bologna, Italy

[21] Appl. No.: 609,406

[22] Filed: Nov. 5, 1990

[30] Foreign Application Priority Data

Nov. 17, 1989 [IT] Italy ..... 3707 A/89

[51] Int. Cl.[5] ..... B21J 15/22

[52] U.S. Cl. ..... 29/243.525; 29/243.523; 29/243.521; 72/453.17

[58] Field of Search ..... 29/243.523, 243.524, 29/243.525, 243.521; 72/391.2, 391.4, 453.17, 453.19

[56] References Cited

U.S. PATENT DOCUMENTS 3,777,540 12/1973 Siebol et al. ..... 29/243.524
4,116,036 9/1978 Sheffield et al. ..... 29/243.525
4,130,006 12/1978 Ebbert et al. ..... 29/243.525
4,903,522 2/1990 Miller ..... 29/243.525

*Primary Examiner*—David Jones
*Attorney, Agent, or Firm*—Dvorak and Traub

[57] ABSTRACT

In a conventional hydropneumatic gun, blind rivets are pulled and clinched by a single-acting spring-loaded hydraulic cylinder, with force applied by a power unit connected up to a supply of compressed air and incorporating a plunger proportioned and reciprocated in such a way as to actuate the hydraulic cylinder with non-compressible oil displaced under pressure from a master cylinder; the device, which permits of making up any loss in hydraulic pressure, comprises a reservoir connected with the master cylinder, a system by which a reserve supply of the same hydraulic oil held in the reservoir is kept suitably pressurized, and a ball check located between the reservoir and the master cylinder that opens to connect the cylinders to the reserve supply each time the plunger returns to its at-rest position, in readiness to clinch the next rivet.

8 Claims, 2 Drawing Sheets

2
25
26
28
27
29
6
1
30
33
92
91
34
3
5
31
22
24
36
15
21
17
R
16
11
14
7

6
33
92
9
91
32
12
5
13
22
C
3
31
4
36
24
18
7
23
17
19
R
8
10
16
20
35
11
14
15
21
37

DEVICE FOR RESTORING LOST FLUID PRESSURE PARTICULARLY IN RIVETING MACHINES

BACKGROUND of the INVENTION

The invention relates to a device for restoring lost fluid pressure, applicable in particular to riveting machines.

Conventionally, blind rivets of both plain and screw shanked types are clinched in simple, safe and practical manner using machines which when hand held and manually operated are often referred to as riveters, or rivet guns.

Most hand riveters are hydropneumatic in design, i.e. connected to a source of compressed air that is manually operated and actuates a hydraulic tool assembly with which the single rivets are rigidly associated.

The hydraulic tool assembly is biased normally by spring means into an at-rest configuration, which precedes the application of a rivet, and connected to a master cylinder filled with hydraulic oil and slidably and sealably accommodating a plunger set in motion by a pneumatic cylinder connected to the compressed air source.

Activation of the compressed air source forces the plunger into the chamber of the master cylinder, thereby displacing and directing the hydraulic oil into the tool assembly against the reaction of the relative spring means. The rush of oil into the hydraulic tool assembly has the effect of pulling the rivet in the axial direction, and subjecting it at the same time it to the necessary upsetting and clinching force.

Guns of the type in question are notably robust in construction, by reason of the high pressures that must be generated in producing the axial pulling force necessary to upset and clinch a rivet. The higher the pressures brought into play however, the greater the problems experienced with fluid tightness, whether due to leakage, capillarity or whatever cause; these affect moving parts above all, given that the integrity of dynamic seals is difficult to guarantee in the long term. Reduced efficiency of the sealing action in a hand riveter results in an undesirable reduction in the travel of the rivet shank.

More exactly, the hydraulic tool assembly comprises a rod to which the rivet shank is attached, and a piston reciprocating within a barrel of which the chamber connects with that of the master cylinder, the piston being biased by the spring means toward a normally at-rest position enabling attachment of the rivet shank; thus, any reduction in efficiency of the sealing action leads to a reduction in the quantity of hydraulic oil contained in the chambers of the master cylinder and tool cylinder.

Each time the pneumatic cylinder is activated, the plunger will effect the full stroke by virtue of its being connected directly to the source of compressed air, which is supplied steadily at unvarying pressure.

Given that the limit positions of the piston of the pneumatic cylinder and the piston of the hydraulic tool assembly are fixed, any egress of hydraulic oil gives place to a corresponding ingress of air; thus, when the pneumatic cylinder is activated, the plunger first compresses the air which has replaced the hydraulic oil lost by reason of the inadequate sealing action, whereupon the oil will be displaced from the master cylinder into the hydraulic tool assembly and the spring means duly compressed. Air being compressible however, the initial movement of the plunger produces no movement of the rod of the hydraulic tool assembly, and neither, obviously, any corresponding movement of the rivet, with the result that the distance traveled by the rivet is reduced.

Such a reduction in travel signifies a technically substandard application of the rivet, as the two heads will be separated ultimately by a distance greater than, or at best equal to the combined thickness of the elements to be fastened together. By contrast, the rivet must be subjected to the axial pulling force mentioned above precisely in order to upset the second head at a distance from the first effectively less than the thickness of the joined elements, to the added end of applying compressive force and thus ensuring a more stable connection.

Currently, any such fault is remedied by completely stripping down, overhauling and reassembling the gun, and thereafter, recharging the master cylinder and hydraulic tool assembly with oil to restore the prescribed operating pressure.

These operations can be scheduled to take place at regular periods and/or in the event of detecting a reduction in the operating stroke of the riveter, though in either instance, it must happen that a certain number of rivets will have bee fitted with insufficient clinching force.

Accordingly, the object of the present invention is to overcome the drawback referred to above, whereby the travel of a rivet shank is reduced during the clinching operation as the consequence of a less than fully efficient sealing action internally of the riveting machine.

SUMMARY OF THE INVENTION

The stated object is fully realized in a device for restoring fluid pressure lost through the seals of a hydropneumatic hand riveter during operation. Such riveters comprise a hydraulic tool assembly by which single rivets are pulled and clinched, and a propulsion unit connected to a supply of compressed air and incorporating a plunger positioned and reciprocated in such a way as to actuate the tool assembly by displacing a non-compressible hydraulic oil under pressure from a master cylinder, formed in the handgrip by which the tool assembly and the propulsion unit are rigidly united.

The device proper comprises a reserve chamber or reservoir connected with the chamber of the master cylinder, means by which a non-compressible fluid stored in the reserve chamber is kept permanently pressurized, and a check valve located between the reservoir and the master cylinder that opens to connect the relative chambers each time the plunger and the tool assembly resume their relative at-rest positions.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
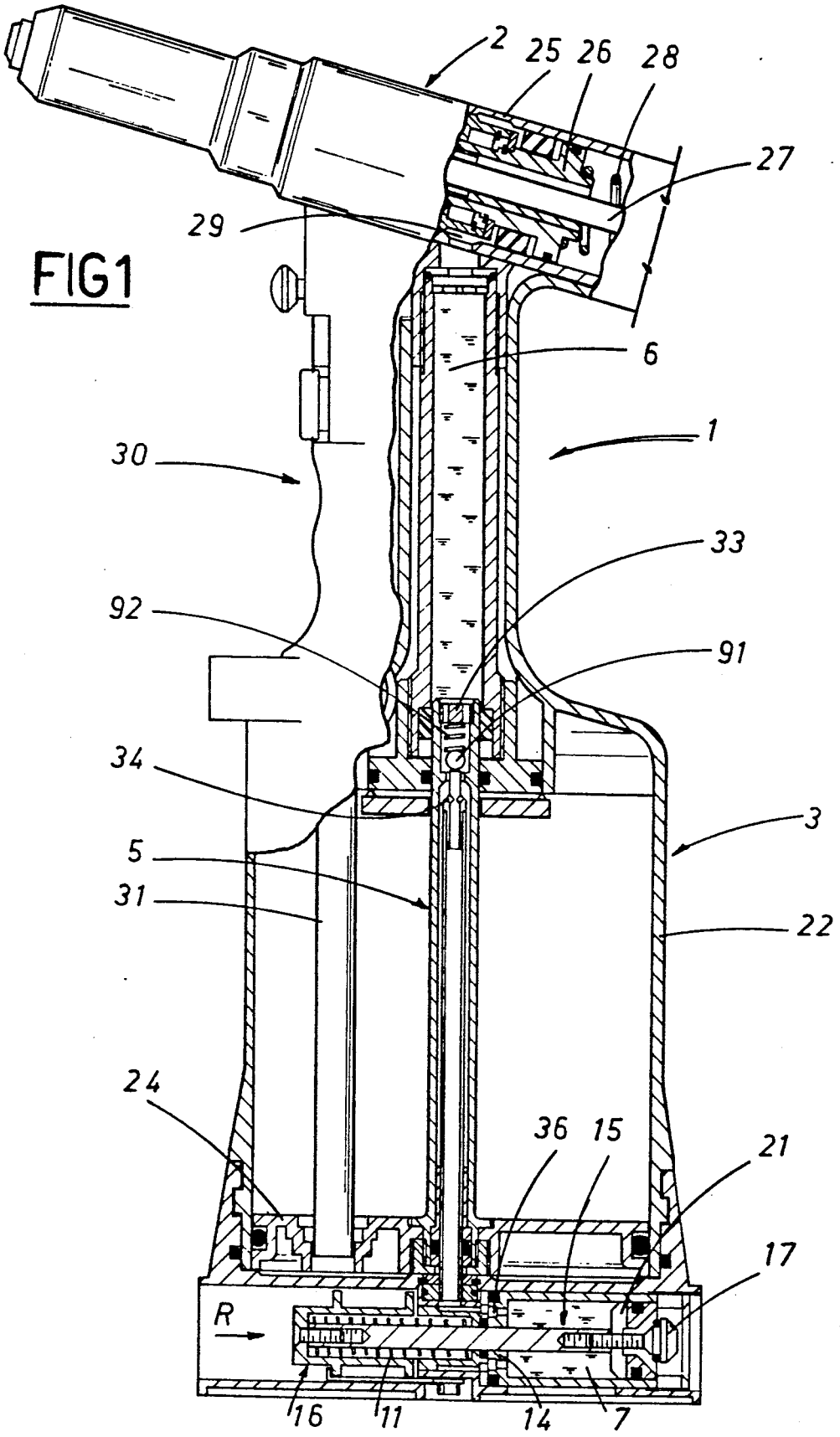
FIG. 1 illustrates a riveter according to the present invention, viewed in side elevation with certain parts in section and certain parts cut away better to reveal others.

With reference to the drawings, a device according to the invention for restoring lost fluid pressure is suitable for integration into a riveting machine denoted 1, in its entirety, consisting essentially in a fluid power tool assembly 2 and a propulsion unit 3.

The fluid power tool assembly 2 is embodied as a single acting hydraulic cylinder, and comprises an outer barrel 25, a piston 26 slidably accommodated inside the barrel 25, a rod 27 rigidly associated with the piston 26, and spring means 28. In the example illustrated, spring means are embodied as a coil spring by which the rod 27 is ensheathed and biased toward the end of the barrel 25 at which the single rivets are attached to the rod 27.

The propulsion unit 3 is embodied as a pneumatic cylinder 4 connected to a source of compressed air (not shown) and comprising a plunger 5 capable of reciprocating to a fluid-tight fit in the chamber 6 of a master cylinder; this chamber 6 is connected permanently with the interior of the barrel 25, and more exactly, with the chamber 29 of the single acting cylinder lying on the side of the piston 26 opposite from the spring 28. The chamber 6 of the master cylinder contains a non-compressible fluid, typically hydraulic oil, such that the entry of the plunger 5 into the chamber 6 and the consequent reduction of available volume therein causes such a fluid to be driven into the chamber 29 of the hydraulic cylinder 2, against the reaction of the spring 28.

The pneumatic cylinder 4 will be seen to comprise an outer barrel 22, a piston 24, a rod (one and the same as the plunger 5), and a cover 23 by which one end of the barrel 22 is capped, the remaining end of the barrel being rigidly associated with the hydraulic cylinder 2. Where the riveter 1 is of gun type embodiment, the barrel 22 of the pneumatic cylinder will be formed into a handgrip 30 at the end connected to the hydraulic cylinder 2, and fashioned with a longitudinal cavity into which the chamber 6 of the master cylinder is incorporated. The grip 30 also accommodates or incorporates means (not illustrated) by which to control the supply of compressed air to the pneumatic cylinder 4, and is connected to one end of a duct 31 running parallel to the plunger 5 internally of the barrel 22, which passes through the piston 24 in a sealed fit to emerge into the chamber of the pneumatic cylinder 4 encompassed by the barrel 22, the piston 24 and the end cover 23.

In the non-operative configuration of the pneumatic cylinder 4, the piston 24 is positioned in close proximity to the end cover 23 (as in FIG. 1) and held thus by conventional means not illustrated in the drawings.

The device according to the invention consists essentially in a reserve chamber or reservoir 7, filled with a non-compressible fluid and connected to the chamber 6 of the master cylinder, means 8 by which to maintain a given pressure of the fluid in the reserve chamber or reservoir 7, and non-return means 9 located between the reserve chamber or reservoir 7 and the master cylinder chamber 6. The non-compressible fluid in question will be the same hydraulic oil as is contained in the chamber 6 of the master cylinder.

The non-return means 9 are positioned between the master cylinder chamber 6 and reserve chamber or reservoir 7, and structured in such a way as to connect the two only when the hydraulic cylinder 2 and pneumatic cylinder 4 are in their respective at-rest configurations. In short, the reservoir 7 is connected to the master cylinder chamber 6 only when the riveter 1 is ready for the attachment of a rivet.

With specific reference now to the example of the device illustrated in the accompanying drawings, whilst implying no limitation as regards its final embodiment, the plunger 5 affords an axial bore 12, and the non-return means 9 are accommodated in the bore at the end of the plunger 5 inserted into the master cylinder chamber 6.

The non-return means 9 consist in a ball check 91 and spring 92 located between a restriction 32 afforded by the axial bore 12, against which the ball 91 is seated, and a ported plug 33 by which the spring 92 is retained.

13 denotes a contact rod accommodated internally of the axial bore 12, of which one end is rigidly associated with the end cove 23 of the pneumatic cylinder 4; moreover, the hollow plunger 5 and the rod 13 are capable of relative axial movement in mutually fluid-tight association. The rod 13 is axially hollow up to a point marginally short of its unattached projecting end, which exhibits a transverse dimension less than the corresponding internal dimension of the restriction 32 in such a way as enables it to enter into contact with and unseat the ball 91, thereby opening a passage of given section. This same unattached end of the contact rod 13 is also ported with a plurality of radial holes 34 by which the axial bore 12 of the plunger 5 and the hollow interior of the rod itself are connected.

The reserve chamber or reservoir 7 is incorporated directly into the end cover 23 of the pneumatic cylinder 4 and affords a cylindrical interior connected by way of a duct 36, also incorporated into the end cover 23, with the hollow interior of the contact rod 13.

The means denoted 8 coincide with one end wall 10 of the reserve chamber or reservoir 7, which is capable of movement in relation to the remaining end wall 14 and in fluid-tight association with the cylindrical inside wall, along the cylindrical axis of the chamber.

15 denotes a rod coaxial with the reserve chamber or reservoir 7 and passing through the end walls 10 and 14. The rod 15 is accommodated freely by the movable end wall 10 and affords a retaining head 17 seated in fluid-tight contact with the side of the wall 10 located externally of the chamber 7. In the example shown, the external surface of the wall 10 is countersunk to accept a matching cone surface offered by the retaining head 17, in conjunction with a seal serving to maintain a fluid-tight fit between the two surfaces. The movable end wall 10 also comprises at least one through hole 21 serving to vent the reserve chamber or reservoir 7 to the external ambient. Clearly enough, given that the hole 21 is located internally of the contact area encompassed by the seal of the retaining head 17, the chamber 7 can be vented only when the wall 10 and the head 17 are distanced one from the other. Accordingly, the relative means 8 further comprise a ring 37 located externally of the chamber 7 and adjoining its cylindrical inner surface, which serves to limit the travel of the movable wall 10 in the external direction.

The rod 15 passes through the fixed end wall 14 in a fluid-tight fit and projects externally beyond the relative end of the chamber 7; this projecting end of the rod 15 carries a restraint cap 16 and is ensheathed by a coil spring 11 seated between and serving to distance the cap 16 and the end wall 14. The same spring 11 serves at one and the same time to draw the retaining head 17 and the movable end wall 10 toward the fixed end wall 14 and thus exert a compressive force on the contents of the reserve chamber or reservoir 7.

The restraint cap 16 consists in a cupped element ensheathing the coil spring 11, as illustrated in FIG. 1, and affording two peripheral stops 18 and 19 projecting from its external surface; 20 denotes flexible means anchored to the end cover 23, which are positioned to engage the stops 18 and 19 of the cap 16 and oppose the action of the coil spring 11. In the example illustrated, such means 20 appear as a flexible catch secured to the end cover 23 at a point coinciding with an opening denoted 35, of which the tip is bent upwards in such a way as to interfere with the two projecting stops 18 and 19. Thus, the stop 18 nearest to the fixed end wall 14 serves to limit the travel of the rod 15 with the spring 11 expanding, whereas the remaining stop 19 is positioned to act as a detent, its engagement by the flexible catch 20 coinciding with abutment of the movable end wall 10 against the ring limiter 37 and separation of the retaining head 17 from the wall 10.

Figure 2:
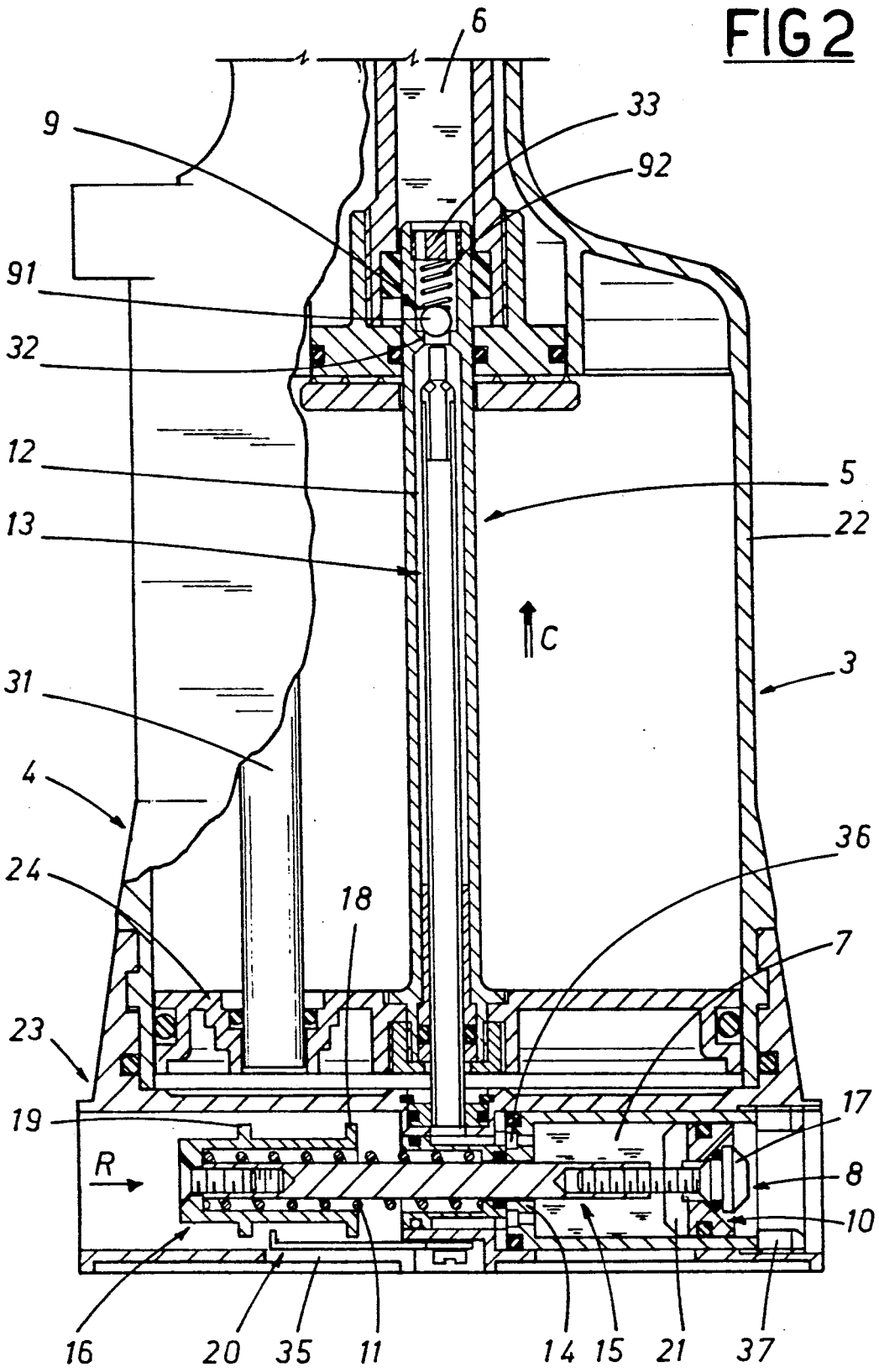
FIG. 2 illustrates the riveter of FIG. 1, viewed in an intermediate configuration of its full operating cycle.

Operation of a device thus embodied will now be described, departing from a situation in which the reserve chamber or reservoir 7 is filled with oil and the tip of the catch 20 located between the stops 18 and 19 of the restraint cap 16. Activating the pneumatic cylinder 4, the plunger 5 will be driven into the chamber 6 of the master cylinder, in the direction denoted C in FIG. 2; the contact rod 13 effects no movement, being rigidly associated with the end cover 23, and following an initial movement of the plunger 5 the ball check 91 will be lifted by the restriction 32 and distanced from the rod 13. Thereafter, the hollow bore 12 of the plunger 5 remains blocked by the ball 91 and the fluid occupying the master cylinder chamber 6 is pressurized and driven into the chamber 29 of the hydraulic cylinder 2. The seal between the ball check 91 and the restriction 32 is maintained both by the action of the spring 92 and by the pressure of the hydraulic oil in the chamber 6. The entry of oil into the chamber 29 of the tool assembly causes the piston 26 to shift against the reaction of the spring 28 with the result that the rivet associated with the rod 27 is subjected to the requisite axial clinching force.

On completion of the stroke accomplished jointly by the plunger 5 and the hydraulic piston rod 27, the combined action of the spring 28 and other means (not illustrated) will return the pistons 24 and 26 to their respective at-rest positions, and as the pneumatic piston 24 reaches a given point near to the end cover 23, the ball 91 will be halted by the unattached end of the contact rod 13 and unseated from the restriction 32, rendering the non-return means inoperative and connecting the chamber 6 of the master cylinder with the reserve chamber or reservoir 7. In the event that a loss of hydraulic oil may have occurred for whatever reason (leakage, capillarity, etc.,), thus reducing the quantity of oil in the master cylinder chamber 6, hydraulic oil stored in the reserve chamber or reservoir 7 and maintained under pressure by the spring 11 will be transferred by way of the duct 36 and the bore of the contact rod 13 to the chamber 6 of the master cylinder, thus entirely making up the loss. The coil spring 11 will of course be calibrated to maintain the reserve oil at a pressure not less than the continuous hydraulic operating pressure of the riveter.

The make-up of oil to the master cylinder chamber 6 can continue, naturally enough, as long as there is a supply of hydraulic oil available in the reserve chamber or reservoir 7. With the reservoir empty, it suffices to depress the restraint cap 16 toward the relative wall 14 in the direction denoted R. Once the rear stop 19 engages the catch 20, the cap remains axially in detent with the coil spring 11 compressed. The retaining head 17 is distanced from the movable wall 10, the wall having registered against the relative limiter 37, and fresh oil can be put into the reservoir 7 by way of the holes 21. Given that the reserve chamber or reservoir 7 is vented externally in this configuration, and the movable wall 10 rendered stable in relation to the end cover 23 by the action of its own seal, the reservoir 7 can be replenished without the aid of any pressurizing medium. Once the reservoir 7 is full, the cap 16 can be released by distancing the catch 20 from the stop 19, access being gained by way of the opening 35.

The object stated at the outset is thus realized comprehensively in a device for restoring lost fluid pressure according to the present invention, in that the chamber 6 of the master cylinder is maintained permanently full and the stroke of the tool cylinder rod 27 remains unaffected by any possible loss of hydraulic oil.

To particular advantage, a device according to the invention can be fitted to hand riveters of current manufacture, and with minimal replacement of parts; in effect, only the end cover 23 and the assembly comprising the piston 24 and plunger 5 need to be substituted.

From the practical standpoint, the advantages of the invention are evident, as the user need do no more than make a periodic and purely visual check for possible shift of the movable wall 10 and the restraint cap 16. In the event that the reservoir should need topping up with hydraulic oil moreover, there is no requirement for parts to be dismantled. No less advantageous is the fact that the stroke of the tool piston rod 27 will remain unaffected even though a loss of hydraulic oil may go temporarily unobserved, so that the gun 1 is able to continue clinching correctly.

What is claimed:

1. A device for restoring lost fluid pressure in riveting machines comprising:

a fluid power tool assembly for exerting a force on a rivet in response to displacement of a non-compressible fluid under pressure;

a propulsion unit for supplying a non-compressible fluid under pressure to said fluid power tool assembly including a master cylinder having a chamber connected with said fluid power tool assembly, said chamber containing a non-compressible fluid, a powered pneumatic cylinder connected with said master cylinder, and a plunger having an axial dimension and one end reciprocally located within said pneumatic cylinder and an opposing end reciprocably located within and in fluid-tight association with the chamber of said master cylinder, wherein said powered pneumatic cylinder when actuated moves said plunger to effect displacement of said non-compressible fluid and to power said power tool assembly; and fluid pressure restoration means for restoring fluid pressure lost during operation of the fluid power tool assembly including a reserve chamber or reservoir interconnectable with the chamber of said master cylinder, said reserve chamber or reservoir containing a non-compressible fluid, and mechanically actuated non-return means located along the axial dimension of said plunger and between said reserve chamber or reservoir and the chamber of said master cylinder.

2. A device for restoring lost fluid pressure as in claim 1, further comprising a contact rod having one end fixed in relation to the propulsion unit and a projecting end extending along an axial bore within said plunger, said rod and plunger being capable of relative axial movement in mutually fluid-tight association, wherein said reservoir chamber or reservoir connects permanently with said axial bore and interconnects with the chamber of said master cylinder upon said contact rod energizing and deactivating said non-return means.

3. A device for restoring lost fluid pressure in riveting machines as claimed in claim 2, wherein said contact rod comprises an axially hollow interior permanently connecting said reserve chamber or reservoir with said axial bore of said plunger.

4. A device for restoring lost fluid pressure in riveting machines as claimed in claim 1, wherein said reserve chamber comprises a cylindrical reserve chamber or reservoir including a fixed end wall and an opposing movable end wall, said movable end wall having an access vent therethrough, wherein said opposing movable end wall is capable of axial movement in fluid-tight association within said cylindrical reserve chamber or reservoir in relation to said fixed end wall, and a spring for biasing said movable end wall toward said fixed end wall.

5. A device for restoring lost fluid pressure in riveting machines as claimed in claim 4, further comprising pressurizing means for pressurizing the fluid within the reserve chamber or reservoir, including a rod extending along the axial dimension of said cylindrical reserve chamber or reservoir, one end of said rod extending through said fixed end wall and being connected with a restraint cap, and an opposing end of said rod extending through said movable end wall and being connected with a retraining head, said spring being located between said restraint cap and said fixed end wall, wherein said spring draws said rod through said fixed end wall and urges said retaining head in fluid-tight association with said vent located through said movable end wall.

6. A device for restoring lost fluid pressure in riveting machines as claimed in claim 5, further comprising at least one peripheral stop projecting from the external surface of said restraint cap to engage with catch means during movement of said rod, and wherein said two end walls are set apart at a maximum distance one from the other upon compression of said spring and engagement of said catch means with said peripheral stop, for separating said retaining head from said movable end wall and affording access to said reserve chamber or reservoir through said vent of non-compressible fluid.

7. A device for restoring lost fluid pressure in riveting machines as claimed in claim 6, further comprising a limiter ring located external to said movable end wall in fixed relation to said reserve chamber or reservoir, wherein said limiter ring limits movement of said movable end wall upon engagement of the projection of the restraint cap by the detent means.

8. A device for restoring lost fluid pressure in riveting machines as claimed in claim 1, wherein said pneumatic cylinder of said propulsion unit comprises a cylindrical barrel capped at one end by an end cover and accommodating a coaxially disposed piston connected to said end of said plunger located within said pneumatic cylinder, wherein said reserve chamber or reservoir of said fluid pressure restoration means is embodied integrally with the end cover.

* * * * *